US005503779A

United States Patent [19]

Adamy et al.

[11] Patent Number: 5,503,779

[45] Date of Patent: Apr. 2, 1996

[54] HIGH FOAMING LIGHT DUTY LIQUID DETERGENT

[75] Inventors: Steven Adamy, Hamilton; Sat Bedi, Edison; Ammanuel Mehreteab, Piscataway, all of N.J.

[73] Assignee: Colgate Palmolive Company, Piscataway, N.J.

[21] Appl. No.: 414,246

[22] Filed: Mar. 20, 1995

[51] Int. Cl.[6] ..... C11D 1/29; C11D 1/90; C11D 1/94; C11D 3/382

[52] U.S. Cl. ..... 252/546; 252/551; 252/174.17; 252/174.21; 252/174

[58] Field of Search ..... 252/546, 551, 252/174.17, 174.21, 174

[56] References Cited

U.S. PATENT DOCUMENTS

| | | | |
|---|---|---|---|
| 3,658,985 | 4/1972 | Olson et al. | 424/70 |
| 3,769,398 | 10/1973 | Hewitt | 424/70 |
| 3,935,129 | 1/1976 | Jabalee | 252/525 |
| 4,013,787 | 3/1977 | Varlerberghe et al. | 424/70 |
| 4,129,515 | 12/1978 | Foster | 252/117 |
| 4,154,706 | 5/1979 | Kenkare et al. | 252/547 |
| 4,224,195 | 9/1980 | Kawasaki et al. | 252/546 |
| 4,329,334 | 5/1982 | Su et al. | 424/70 |
| 4,329,335 | 5/1982 | Su et al. | 424/70 |
| 4,450,091 | 5/1984 | Schmolka | 252/174.21 |
| 4,595,526 | 6/1986 | Lai | 252/545 |
| 4,704,453 | 11/1987 | Lorenz et al. | 536/18.6 |
| 5,035,832 | 7/1991 | Takamura et al. | 252/174.15 |
| 5,230,823 | 7/1993 | Wise et al. | 252/174.21 |
| 5,284,603 | 2/1994 | Repinec, Jr. et al. | 252/546 |
| 5,385,696 | 1/1995 | Repinec, Jr. et al. | 252/546 |
| 5,387,375 | 2/1995 | Erilli et al. | 252/546 |
| 5,389,304 | 2/1995 | Repinec, Jr. et al. | 252/546 |
| 5,389,305 | 2/1995 | Repinec et al. | 252/546 |
| 5,409,640 | 4/1995 | Giret et al. | 252/546 |
| 5,449,763 | 9/1995 | Wulff et al. | 536/18.6 |

FOREIGN PATENT DOCUMENTS

| | | |
|---|---|---|
| 3163198 | 7/1991 | Japan . |

*Primary Examiner*—Erin M. Harriman
*Attorney, Agent, or Firm*—Richard E. Nanfeldt; Murray Grill

[57] ABSTRACT

A high foaming, light duty liquid detergent composition with desirable cleansing properties and mildness to the human skin comprising an anionic surfactant; two zwitterionic betaine surfactants, an alkylglucoside surfactant, an alkylpolyglucoside surfactant and water.

9 Claims, No Drawings

HIGH FOAMING LIGHT DUTY LIQUID DETERGENT

BACKGROUND OF THE INVENTION

The present invention relates to novel light duty liquid detergent compositions with high foaming properties, containing two glucoside surfactants, an anionic surfactant, two zwitterionic betaine surfactants, triethylene glycolmono-undecyl ether or a hydrophobic nonionic surfactant and the balance being water.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the use of nonionic surfactants is limited. There have been substantial interest and efforts to develop a high foaming detergent with nonionic surfactants as the major ingredient. Little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions to be non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either an anionic, amphoteric, or nonionic surfactant. U.S. Pat. No. 4,329,334 discloses an anionic-amphoteric based shampoo containing a major amount of anionic surfactant and lesser amounts of betaine and nonionic surfactants.

U.S. Pat. No. 3,935,129 ;discloses a liquid cleaning composition containing an alkali metal silicate, urea, glycerin, triethanolamine, an anionic surfactant and a nonionic surfactant. The alkali metal silicate content determines the amount of anionic and/or nonionic detergent in the liquid cleaning composition. However, the foaming property of these detergent compositions is not discussed therein.

U.S. Pat. No. 4,129,515 discloses a heavy duty liquid composition for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic surfactants, namely, an ethylene oxide of a secondary alcohol, a specific group of anionic surfactants, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses; detergent compositions containing all nonionic surfactants as shown in U.S. Pat. Nos. 4,154,706 and 4,329,336 wherein the shampoo compositions contain a plurality of particular nonionic surfactants in order to achieve desirable; foaming and detersive properties despite the fact that nonionic surfactants are usually deficient in such properties.

U.S. Pat. No. 4,013,787 discloses the use of a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic surfactant, an anionic surfactant, a fatty acid alkanolamide and a polyoxyalkylene glycol fatty ester.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

However, none of the above-cited patents discloses a high foaming, light duty liquid detergent composition containing a triethylene glycol mono-undecyl ether, an ethoxylated alkyl ether sulfate anionic surfactant, two glucoside surfactants and two supplementary foaming betaine surfactants, wherein the composition does not contain any amine oxides, calcium carbonates, polymeric or clay thickeners, abrasives, clays, silicas, alkylglycine surfactants, sulfonate surfactants, alkyl sulfate surfactants, cyclic imidinium surfactants, or more than 3.0 wt. % of fatty acids or metal salts of a fatty acid.

SUMMARY OF THE INVENTION

It has now been found that a high foaming liquid detergent can be formulated which has desirable cleaning properties and mildness to the human skin.

An object of this invention is to provide novel, aqueous light duty liquid detergent compositions containing an ethoxylated alkyl ether sulfate anionic surfactant, two glucoside surfactants, two zwitterionic betaine surfactants, and a triethylene glycol mono-undecyl ether or a hydrophobic nonionic surfactant, wherein the composition does not contain amine oxides, alkali metal carbonates, polymeric or clay thickeners, clays, abrasives, alkyl glycine surfactants, sulfonate surfactants, alkyl sulfate surfactants, cyclic imidinium surfactants, silicas, fatty acids or a metal salt of a fatty acid.

Another object of this invention is to provide a novel, liquid detergent composition with desirable high foaming and cleaning properties which is also mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, light duty liquid detergent composition of this invention comprises two foaming water soluble, zwitterionic surfactant selected from the class of betaines; an ethoxylated alkyl ether sulfate surfactant, two glucoside surfactants and triethylene glycol mono-undecyl ether wherein the ingredients are dissolved in an aqueous vehicle, and the composition does not contain any amine oxide or alkanolamide ingredients.

The total amount of surfactants may constitute 10 to 55%, preferably 20 to 40%, most preferably 25 to 35%, by weight of the liquid composition.

DETAILED DESCRIPTION OF THE INVENTION

The high foaming nonionic based light duty liquid detergent compositions of the instant invention comprise approximately by weight:

(a) 6% to 16% of a $C_8$–$C_{14}$ ethoxylated alkyl ether sulfate surfactant;

(b) 2% to 6% of a cocamidoalkyl betaine surfactant;

(c) 1% to 5% of an alkyldimethyl betaine surfactant;

(d) 0.25% to 5.0% of triethylene glycol mono-undecyl ether or a nonionic surfactant;

(e) 10% to 20% of an alkyl polyglucoside surfactant;

(f) 4% to 12% of an alkylglucoside surfactant;

(g) 1% to 10% of a magnesium containing compound; and (h) the balance being water.

The cocoamidoalkyl betaine surfactants which are present in the light duty liquid composition at a concentration of about 2% to about 6%, more preferably about 3% to about 5.5% by weight are selected from the group consisting of cocoamidoethyl betaine surfactant and cocoamidopropyl betaine surfactant and mixtures thereof.

The alkyldimethyl betaine surfactants are present in the light duty liquid composition at a concentration of about 1% to about 5%, more preferably about 2% to about 4% by weight. The alkyldimethyl betaine surfactant has an alkyl group having about 10 to about 20 carbon atoms. Preferred alkyldimethyl betaine surfactants are decyldimethyl betaine, myristyldimethyl betaine, palmityldimethyl betaine, lauryldimethyl betaine, cetyldimethyl betaine and stearyldimethyl betaine and mixtures thereof.

The ethoxylated alkyl ether sulfate (AEOS.xEO) surfactant which is present in the light duty liquid composition at a concentration of about 6% to about 16%, more preferably about 8% to about 14% by weight is depicted by the formula: $R\text{-}(OCHCHC_2)x\ OSO_3M$ wherein x is about 1 to 10, more preferably about 1 to about 5 and R is an alkyl group having about 8 to 18 carbon atoms and more preferably about 12 to about 15 carbon atoms and natural cuts for example $C_{12\text{-}14}$, $C_{12}$–$C_{13}$ and $C_{12\text{-}15}$ and M is an alkali metal cation such as sodium or potassium. Examples of satisfactory anionic ethoxylated alkyl ether sulfates are the $C_{8\text{-}18}$ ethoxylated alkyl ether sulfate salts having the formula: $R'(OCH_2\text{–}H_4)n\ OSO_3M$ wherein R' is alkyl of 8 or 9 to 18 carbon atoms, n is 1 to 10, preferably 1 to 5, and M is a sodium or potassium cation. The ethoxylated alkyl ether sulfates may be made by sulfating the condensation product of ethylene oxide and $C_{8\text{-}18}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether sulfates contain 10 to 16 carbon atoms in the alcohols and in the alkyl groups thereof wherein said ethoxylated alkyl ether sulfate can be sodium laureth-1-sulfate.

The instant compositions contain about 10% to about 20%, more preferably about 12% to about 18% by weight of an alkylpolysaccharide surfactant. The alkylpolysaccharides surfactants, which are used in conjunction with the aforementioned surfactant have a hydrophobic group containing from 8 to 20 carbon atoms, preferably from 10 to 16 carbon atoms, most preferably from 12 to 14 carbon atoms, and polysaccharide hydrophilic group containing from 1.5 to 10, preferably from 1.5 to 4, most preferably from 1.6 to 2.7 saccharide units (e.g., galactoside, glucoside, fructoside, glucosyl, fructosyl; and/or galactosyl units). Mixtures of saccharide moieties may be used in the alkyl polysaccharide surfactants. The number x in the hereinafter depicted formula indicates the number of saccharide units in a particular alkyl polysaccharide surfactant. For a particular alkyl polysaccharide molecule x can only assume integral values in any physical sample of alkylpolysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions of the saccharide unit rather than at the 1- position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6- positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from 8 to 20, preferably from 10 to 18 carbon atoms. Preferably, the alkyl group is a straight chain saturated alkyl group. The alkyl group can contain up to 3 hydroxy groups and/or the polyalkoxide chain can contain up to 30, preferably less than 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(CnH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from 10 to 18, preferably from 12 to 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkylpolyglucosides can be prepared by a two step procedure in which a short chain alcohol ($R_1OH$) can be reacted with glucose, in the presence of an acid catalyst to form the desired glucoside. Alternatively, the alkylpolyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than 5%, most preferably 0% of the alkyl polyglucoside.

The amount of unreacted alcohol (the free fatty alcohol content) in the desired alkylpolysaccharide surfactant is preferably less than 2%, more preferably less than 0.5% by weight of the total of the alkylpolysaccharide. For some uses it is desirable to have the alkylmonosaccharide content less than 10%.

The used herein, "alkylpolysaccharide surfactant" is intended to represent both the preferred glucose and galactose derived surfactants and the less preferred alkyl polysaccharide surfactants. Throughout this specification, "alkylpolyglucoside" is used to include alkylpolyglycosides because the stereochemistry of the saccharide moiety is changed during the preparation reaction.

An especially preferred APG glycoside surfactant is APG 600 glycoside, manufactured by the Henkel Corporation. APG 600 is a nonionic alkyl polyglycoside characterized by the formula:

$$C_nH_{2n+1}O(C_6H_{10}O_5)_zH$$

wherein n possesses an average value of 12 and z (degree of polymerization)=1.4. APG 600 is especially preferable since it is not classified as a skin irritant according to European regulations.

Another APG glycoside surfactant is APG 625 glycoside manufactured by the Henkel Corporation of Ambler, Pa. APG25 is a nonionic alkylpolyglycoside characterized by the formula:

$$C_nH_{2n+1}O(C_6H_{10}O_5)_zH$$

wherein n=10 (2%); n=122 (65%); n=14 (21–28%); n=16 (4–8%) and n=18 (0.5%) and z (degree of polymerization)=1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., #21 spindle, 5– 10 RPM of 3,000 to 7,000 cps. A preferred alkyl polyglucoside surfactant is lauryl polyglucoside having a DP of about 1.4.

The alkylglucoside which is present in the light duty liquid composition is present at a concentration of about 4% to about 12%, more preferably about 6% to about 10% by weight. The alkyl group of the alkylglucoside surfactant has about 2 to about 5 carbon atoms, wherein the preferred alkyl group is a butyl group.

The light duty liquid composition contains about 0.25% to about 5%, more preferably about 1% to about 4% by weight of triethylene glycol mono-undecyl ether or a nonionic surfactant having the formula $C_nEOx$ wherein n is about 8 to 18 carbon atoms and x is about 3 to about 20. The composition also contains about 1% to about 10%, more preferably about 2% to about 9% by weight of magnesium sulfate heptahydrate as the magnesium containing compound.

The particular combination of alkali metal (AEOS.XEO) surfactant, two glucoside surfactants, and two betaine surfactants and a nonionic surfactant or triethylene glycol mono-undecyl ether, provides a detergent system with desirable foaming, foam stability and detersive properties. Surprisingly, the resultant homogeneous liquid detergent composition exhibits the same or better foam performance, both as to initial foam volume and stability of foam in the presence of soils, and cleaning efficacy as an anionic based light duty liquid detergent (LDLD) as shown in the following Examples.

The essential ingredients discussed above are solubilized in an aqueous medium comprising water and optionally, solubilizing ingredients such as alcohols and dihydroxy alcohols such as C2–C3 mono- and di-hydoroxy alkanols, e.g. ethanol, isopropanol and propylene glycol. Suitable water soluble hydrotropic salts include sodium, potassium, ammonium and mono-, di- and triethanolammonium salts of benzene sulfonate or xylene sulfonate. While the aqueous medium is primarily water, preferably the solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from about 0.5% to about 8%, preferably about 1% to about 7%, by weight of the detergent composition with the proportion of ethanol, when present, being 5% of weight or less in order to provide a composition having a flash point above 46° C. Preferably the solubilizing ingredient will be propylene glycol. Another extremely effective solubilizing or cosolubilizing agent used at a concentration of 0.1 to 5 wt. percent, more preferably 0.5 to 4.0 weight percent is isethionic acid or an alkali metal salt of isethionic acid having the formula $$CH_2OHCH_2SO_3X^{-+}$$

wherein X is hydrogen or an alkali metal cation, preferably sodium. The foregoing solubilizing ingredients also facilitate the manufacture of the inventive compositions because they tend to inhibit gel formation.

In addition to the previously mentioned essential and optional constituents of the light duty liquid detergent composition, one may also employ normal and conventional adjuvants, provided they do not adversely affect the properties of the detergent composition. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed about 15% by weight of the detergent composition, and the percentages of most of such individual components will be about 0.1% to about 5% by weight and preferably less than about 2% by weight. Sodium formate can be included in the formula as a perservative at a concentration of about 0.1 to about 4.0% by weight. Sodium bisulfite can be used as a color stabilizer at a concentration of about 0.01 to about 0.2 wt. %. Typical perservatives are dibromodicyano-butane, citric acid, benzylic alcohol and poly (hexamethylene-biguamide) hydrochloride and mixtures thereof. The instant composition can also contain 0 to about 2.5 wt. %, more preferably about 0.025 to about 2.0 wt. %, most preferably about 0.05 to about 1.0 wt. % of an antibacterial agent. A preferred antibacterial agent is trichlorohydroxydiphenyl ether.

The present light duty liquid detergent compositions such as dishwashing liquids are readily made by simple mixing methods from readily available components which, on storage, do not adversely affect the entire composition. However, it is preferred that the surfactants be mixed with the solubilizing ingredients, e.g., ethanol and, if present, prior to the addition of the water to prevent possible gelation. The surfactant system is prepared by sequentially adding with agitation the anionic surfactant, the two glucoside surfactants and the two betaine surfactants to the triethylene glycol mono undecyl ether or hydrophobic nonionic surfactant, cosolubilizing agent and water, and then adding with agitation the formula amount of water to form an aqueous solution of the surfactant system. The use of mild heating (up to 100° C.) assists in the solubilization of the surfactants. The viscosities are adjustable by changing the total percentage of active ingredients. No polymeric or clay thickening agent is added. In all such cases the product made will be pourable from a relatively narrow mouth bottle (1.5 cm. diameter) or opening, and the viscosity of the detergent formulation will not be so low as to be like water. The viscosity of the detergent desirably will be at least about 100 centipoises (cps) at room temperature, but may be up to about 1,000 centipoises as measured with a Brookfield Viscometer using a number 3 spindle rotating at 18 rpms. The viscosity of the composition may approximate those of commercially acceptable detergents now on the market. The viscosity of the composition and the composition itself remain stable on storage for lengthy periods of time, without color changes or settling out of any insoluble materials. The pH of this formation is substantially neutral to skin, e.g., 4.5 to 8 and preferably 5 to 5.5. The compositions of the instant invention are optically clear—that is they exhibit a light transmission of at least 95%, more preferably at least 98%.

The following examples are merely illustrative of the invention and are not to be construed as limiting thereof.

EXAMPLE 1

The following formulas were prepared at room temperature by simple liquid mixing procedures as previously described. The amounts are expressed as weight percent. Results of performance tests (procedures described below) are compared with results of tests on the commecial dish liquid Palmolive (POL).

| | A | B | C | POL |
|---|---|---|---|---|
| Lauryldimethyl betaine | 3.3 | 2.2 | 1.1 | |
| Cocoamidopropyl Betaine | 4.6 | 3.1 | 1.5 | |
| Na (AEOS.1.3 EO) | 10.7 | 7.1 | 3.6 | |
| Triethylene glycol mono-undecyl ether | 2 | 1.3 | 0.7 | |
| Lauryl polyglucoside (APG 600) | 16 | 10.7 | 5.3 | |
| Butylglucoside | 8.3 | 5.5 | 2.8 | |
| Perfume | 0.2 | 0.1 | 0.1 | |
| $MgSO_4.7H_2O$ | 7.9 | 5.3 | 2.6 | |
| Water | Balance | Balance | Balance | |
| Total Formula Actives Level | 44.7 | 29.8 | 14.9 | 32.1 |
| Milliplate (number of plates) | 34 ± 3 | 27 ± 3 | 19 ± 3 | 31 ± 3 |
| Shell Endpoint (POL = 100) | 206 ± 14 | 140 ± 14 | 70 ± 14 | 100 ± 14 |
| Baumgartner (mg lard) | 37.8 ± 5 | 33.5 ± 5 | 28.9 ± 5 | 17.6 ± 5 |

Formula A has a higher actives level than POL, B has a level of actives that is about the same as POL, and C has an actives level which is less than half that of POL.

By comparing the results of tests on B and POL, it can be seen that B performs as well or better than POL, displaying nearly twice the grease solubilizing capacity as POL (as shown from the Baumgartner test), and about one and one-half times the foam lifetime as POL (as measured by the Shell Test). Formula B performs about the same with regards to the number of miniplates washed.

The invention may be employed as a high efficacy product if the actives are more concentrated, as in Formula A. The Shell Endpoint significantly increases to twice the level of POL, but the invention would offer the advantage of being a high efficacy product that is mild due to the mild surfactants used.

A comparison of the performances of C and POL demonstrates that the invention remains efficacious when diluted to an actives level that is less than half that of the commerical POL. Though the miniplate number is reduced, the solubilizing power is demonstrated by the high Baumgartner number. The Shell Endpoint is also, within the error, close to that of POL. The invention therefore still performs well under conditions of significant dilution.

Test Procedures

Miniplate Test:

The procedure for the Miniplate test was taken from the paper by Anstett and Schuck [JAOCS 43,576 (1966)]. In a 150×75 mm crystallization dish, 400 ml of a 0.125% (formula concentration) test solution is heated and equilibrated at 115° F. The hardness of the water is 150 ppm. The solution is agitated with a stiff brush until the foam completely covers the solution surface (about 1 minute). Watch glasses, on each of which is spread 0.12 g of Crisco Shortening, are washed in the solution with a soft brush. The brush is rotated on each glass at a rate of about 4 strokes per minute. The endpoint or "Miniplate Number" is taken as the number of glasses (or plates) which can be washed before the foam disappears.

The Miniplate Numbers for the cited examples of the invention were determined by a device which automates the above procedure. The Miniplate Number has been found to be directly relatable to the amount of soil which can be injected at a constant rate into a test solution while the solution is agitated with a stiff brush. The solution temperature, volume, and concentration, as well as the size of the test vessel, are the same as in the manual test. First, the device is calibrated with standards having known Miniplate values as determined by the manual procedure. Miniplate Numbers of test solutions are then determined from the empirical calibration.

Shell Soil Titration Test:

The following soil was prepared:

15.00% Crisco vegetable shortening
15.00% French's potato starch
15.00% Progresso olive oil
30.00% Homogenized milk
0.200% Formaldehyde
balance Deionized water Ten ml of a 1% formula detergent solution in 150 ppm water was placed in a glass test vessel thermostatted at 113° F. An additional 240 ml of 150 ppm water was then added to the test vessel. The solution was stirred with an overhead stirrer at 300 rpm until temperature equilibration occurred and until a foam layer covered the vortex around the stirring shaft. After the soil was loaded into a syringe, the weight of the syringe and soil was recorded. The soil was then infused into the stirring solution at a rate of approximately 0.5 ml/min. The stirred detergent solution was continually monitored until the endpoint was reached. The endpoint was taken to be when a vortex appeared in the stirred solution. The syringe was then weighed to establish the amount of soil that was used.

The Shell test number was calculated according to:

$$\text{Shell Test Number} = \frac{\text{Weight of soil used in test of formula}}{\text{Weight of soil used in test of Palmolive}} \times 100$$

Baumgartner Test:

Both sides of a plastic slide were evenly coated with about 0.25 grams of lard. The slides were then dipped in 250 ml of the test solution in a 250 ml beaker 600 times. All tests were performed in 150 ppm hardness water using formula concentrations of 1% (by weight). In all cases the temperature was 25° C. After dipping, the slides were dipped twice in deionized water and placed in desiccator to dry overnight. The slides were then weighed to determine the amount of lard removed.

What is claimed is:

1. A high foaming, light duty liquid detergent composition comprising approximately by weight:

(a) 6% to 16% of a $C_8$–$C_{14}$ ethoxylated alkyl ether sulfate surfactant;

(b) 2% to 6% of a cocoamidoalkyl betaine surfactant;

(c) 1% to 5% of an alkyldimethyl betaine surfactant;

(d) 0.25% to 5.0% of triethylene glycol mono-undecyl ether;

(e) 10% to 20% of an alkylpolyglucoside surfactant;

(f) 4% to 12% of an alkylglucoside surfactant;

(g) 1% to 10% of a magnesium sulfate; and (h) the balance being water, wherein said high foaming light duty liquid detergent composition is homogenous and optically clear and said C8–C14 ethoxylated alkyl ether sulfate surfactant, said cocoamido-alkyl betaine surfactant, said alkyl dimethyl betaine surfactant, said triethylene glycol mono-undecyl ether, said alkyl polyglucoside surfactant, said alkyl glucoside surfactant and said magnesium containing compound are all dissolved in said water and said high foaming, light duty, liquid detergent composition is pourable from a bottle having a 1.5 cm diameter neck opening and has a viscosity at room temperature of from at least about 100 centipoise up to about 1000 centipoise as measured with a Brookfield Viscosimeter using a number 3 spindle rotating at 18 rpm.

2. A liquid detergent composition according to claim 1, wherein said alkyl glucoside is butylglucoside.

3. A liquid detergent composition according to claim 2, wherein said alkyl polyglucoside is laurylpolyglucoside.

4. A liquid detergent composition according to claim 3, wherein said alkyl dimethyl betaine is lauryldimethyl betaine.

5. A liquid detergent composition according to claim 4, wherein said cocoamidoalkyl betaine is cocoamido propyl betaine.

6. A liquid detergent composition according to claim 5, wherein said ethoxylated alkyl ether sulfate surfactant is sodium laureth-1-sulfate.

7. A liquid detergent composition according to claim 1 further including a perservative.

8. A liquid detergent composition according to claim 1 further including a color stabilizer.

9. A liquid detergent composition according to claim 1 further including about 0.025 to about 2.0 wt. % of an antibacterial agent.

* * * * *